US011790829B1

(12) United States Patent
Zhou et al.

(10) Patent No.: US 11,790,829 B1
(45) Date of Patent: Oct. 17, 2023

(54) DATA DRIVING CIRCUIT AND DISPLAY PANEL

(71) Applicant: HKC CORPORATION LIMITED, Guangdong (CN)

(72) Inventors: Luhong Zhou, Guangdong (CN); Ruidi Ran, Guangdong (CN); Xuemei Chen, Guangdong (CN); Rongrong Li, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/334,927

(22) Filed: Jun. 14, 2023

(30) Foreign Application Priority Data

Oct. 26, 2022 (CN) ..... 202211315106.1

(51) Int. Cl.
*G09G 3/20* (2006.01)
*G09G 3/32* (2016.01)

(52) U.S. Cl.
CPC ..... *G09G 3/2096* (2013.01); *G09G 3/32* (2013.01); *G09G 2310/027* (2013.01); *G09G 2310/0275* (2013.01); *G09G 2320/0233* (2013.01)

(58) Field of Classification Search
CPC ..... G09G 3/32
See application file for complete search history.

(56) References Cited

FOREIGN PATENT DOCUMENTS

| | | | |
|---|---|---|---|
| CN | 1760721 | A | 4/2006 |
| CN | 101567624 | A | 10/2009 |
| CN | 101567629 | A | 10/2009 |
| CN | 101957628 | A | 1/2011 |
| CN | 104200776 | A | 12/2014 |
| CN | 204632314 | U | 9/2015 |
| CN | 109640457 | A | 4/2019 |
| CN | 110390907 | A | 10/2019 |
| CN | 114141203 | A | 3/2022 |
| WO | 2022035052 | A1 | 2/2022 |

OTHER PUBLICATIONS

Machine Translation of Xu et al. CN 109640457 A (Year: 2023).*
The first office action issued in corresponding CN application No. 202211315106.1 dated Dec. 16, 2022.

* cited by examiner

*Primary Examiner* — Gustavo Polo
(74) *Attorney, Agent, or Firm* — HAUPTMAN HAM, LLP

(57) ABSTRACT

Provided is a data driving circuit and a display panel. The data driving circuit is configured to output a data signal for image display to multiple pixel units so as to drive the pixel units to display images. The data drive circuit includes a voltage regulating unit and multiple constant-current driving units, where the constant-current driving unit is configured to output a drive current corresponding to a data signal to at least one pixel unit. The voltage regulating unit is electrically connected to the multiple constant-current driving units and is configured to detect a driving current output by each constant-current driving unit and obtain a detection signal, and control the driving current output by each constant-current driving unit to be within a preset range according to the detection signal. The driving current output by each constant-current driving unit is adjusted.

14 Claims, 10 Drawing Sheets

DATA DRIVING CIRCUIT AND DISPLAY PANEL

CROSS-REFERENCE TO RELATED APPLICATION(S)

This application claims priority to and the benefit of Chinese Application No. 202211315106.1, filed Oct. 26, 2022, the entire disclosure of which is hereby incorporated by reference.

TECHNICAL FIELD

The present application relates to the field of display technology, and in particular, to a data driving circuit and a display panel.

BACKGROUND

The Micro Light Emitting Diode (LED) display technology refers to a technology in which self-luminous LEDs of the order of microns are used as light-emitting pixel units, and compared with common LEDs, the Micro LED display technology has a higher density per unit area and a smaller size of a light source unit. Compared with a Liquid Crystal Display (LCD), a Micro LED display screen has a better display effect, and the response speed is improved by an order of magnitude, so that the screen can be lighter and thinner, and the power consumption is lower.

Currently, when a Micro LED display screen displays a pure color picture, the brightness of the display screen can only be adjusted with regard to the entire display screen, however, a single constant-current driving chip in a data driving circuit usually controls the brightness of the Micro LED in a local region. The magnitude of the current output by the constant-current driving chip is determined by an internal register adjusting the current gain and the external resistance. After an external resistor is mounted, the current output of the constant-current driving chip can only be adjusted with the current gain, however, adjustment with the current gain can only control all constant-current driving chips with the same color in the Micro LED in a unified manner, the adjustment however cannot be performed on a single constant-current driver chip, and thus there is a luminance error between regions controlled by different constant-current driver chips. As a result, the overall display brightness of the display screen is non-uniform.

SUMMARY

In view of the above disadvantages of the prior art, the present disclosure provides a data driving circuit and a display panel capable of effectively improving display unevenness.

A data driving circuit, where the data driving circuit is configured to output a data signal for image display to multiple pixel units to drive the pixel units to display images, where the data driving circuit includes a voltage regulating unit and multiple constant-current driving units, the constant-current driving unit is configured to output a driving current corresponding to the data signal to at least one pixel unit, the voltage regulating unit is electrically connected to multiple constant-current driving units, and is configured to detect the driving current output from each constant-current driving unit to obtain a detection signal, and control, according to the detection signal, the driving current output by each constant-current driving unit to be within a preset range.

Optionally, the voltage regulating unit includes a switch module, a current detecting module, a first converting module, and a control module. The switch module is configured to select different constant-current driving units to be connected to the current detecting module, and the current detecting module is configured to detect via the switch module the driving current output by the constant-current driving unit and output a first current detection signal. The first converting module is electrically connected to the current detecting module and is configured to receive the first current detection signal from the current detecting module, convert the first current detection signal into a detection signal in a digital form, and transmit the detection signal to the control module. The control module is configured to output a control signal to the constant-current driving unit according to the detection signal, and the control signal is used to control and adjust a current output by the constant-current driving unit.

Provided herein is a display panel. The display panel includes a display area and a non-display area, where the display area includes multiple pixel units arranged in an array, each pixel unit includes at least one light-emitting element, and the non-display area includes a timing control circuit, a scan driving circuit, and the data driving circuit of any one of claims 1-9, where the timing control circuit is configured to receive an original data signal from an external signal source, output a data output control signal to the data driving circuit, and output a scan output control signal to the scan driving circuit, the data driving circuit is configured to output multiple data signals to multiple columns of pixel units according to the data output control signal, and the scan driving circuit is configured to output a scan signal to multiple rows of pixel units according to the scan output control signal, where the data signal and the scan signal cooperate to provide a driving current for the light-emitting element in the pixel unit, and the light emitting element is configured to emit light and display images according to a potential difference between the data signal and the scan signal.

BRIEF DESCRIPTION OF THE DRAWINGS

To describe technical solutions in embodiments of the disclosure more clearly, the following briefly introduces the accompanying drawings required for describing the embodiments. Apparently, the accompanying drawings in the following description show merely some embodiments of the disclosure, and a person of ordinary skill in the art may still derive other drawings from these accompanying drawings without creative efforts.

Figure 1:
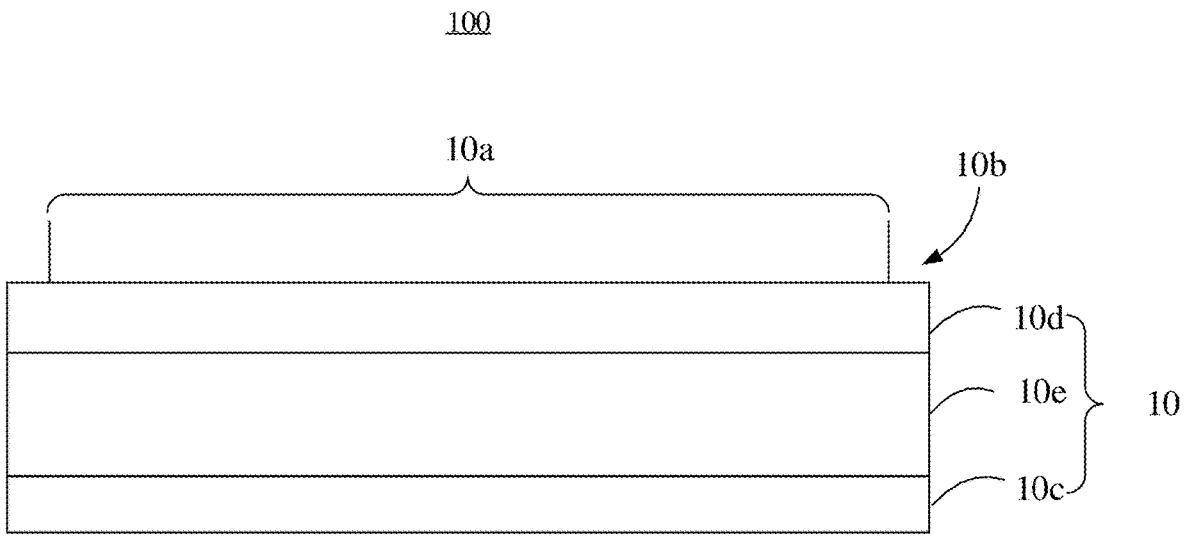
FIG. 1 is a schematic structural diagram of a display device according to a first embodiment of the disclosure.

DESCRIPTION OF REFERENCE SIGNS display device—100, display panel—10, display area—10*a*, non-display area—10*b*, array substrate—10*c*, opposite substrate—10*d*, display medium layer—10*e*, timing control circuit—11, data driving circuit—12, scan driving circuit—13, pixel unit—P, scan line—G1~Gn, data line—S1~Sm, clock signal—CLK, horizontal synchronization signal—Hsyn, vertical synchronization signal—Vsyn, scan output control signal—Cg, data output control signal—Cs, data clock signal—DCLK, gray scale clock signal—GCLK, latch signal—LE, drive voltage—VDD, power supply voltage—VCC, voltage regulating unit—121, constant-current driving unit—122, current output end—OUT, switch module—1211, current detecting module—1212, first converting module—1213, control module—1214, second converting module—1215, voltage regulating module—1216, adjusting module—1221, driving module—1222, first resistor—R1, switch transistor—M, source flow gate—g, source—s, drain—d, drain current—Id, source-drain voltage—Vds, gate-source voltage—Vgs, ground end—E, adjustable resistor—Rv.

DETAILED DESCRIPTION

In order to facilitate understanding of the disclosure, the disclosure will be described more fully hereinafter with reference to the accompanying drawings. Preferred embodiments of the disclosure are shown in the drawings, but the disclosure may be implemented in many different forms and is not limited to the embodiments described herein. Rather, these embodiments are provided so that this disclosure will be thorough and complete.

The following description of the embodiments refers to the accompanying drawings to illustrate specific embodiments of the disclosure. Sequential reference themselves, such as "first", "second", etc., are used merely to distinguish between described objects and do not have any ordinal or technical meaning. However, the expressions "connected" and "coupled" in the disclosure, unless otherwise specified, both include direct connection and indirect connection. Directional terms mentioned in the disclosure, for example, "upper", "lower", "front", "rear", "left", "right", "inner", "outer", "side" and the like are only directions with reference to the accompanying drawings, and therefore, the directional terms are used for better and clearer illustration and understanding of the disclosure, rather than indicate or imply that the indicated device or element must have a particular orientation, be constructed and operated in a particular orientation, therefore, it cannot be understood that the disclosure is limited thereto.

In the description of the disclosure, it should be noted that, unless specified or limited otherwise, the terms "mounted", "connected with", and "connected to" should be understood broadly, for example, may be fixedly connected, may also be detachably connected, or may be integrally connected; may also be mechanical connections; may also be direct connections or indirect connections via intervening structures; and may also be inner communications of two elements. The specific meanings of the above terms in the disclosure can be understood by those skilled in the art according to specific situations. It should be noted that terms such as "first" and "second" in the description and claims and drawings of the disclosure are used for distinguishing different objects, rather than for describing a specific sequence.

In addition, as used herein, the term "include", "may include", "contain" or "may contain" indicates the existence of a corresponding disclosed function, operation, element, etc., and does not exclude one or more other functions, operations, elements, etc. In addition, the terms "comprise" or "include" means that there are corresponding features, numbers, steps, operations, elements, components, or a combination thereof disclosed in the specification, and do not exclude the presence or addition of one or more other features, numbers, steps, operations, elements, components, or a combination thereof, and are intended to cover a non-exclusive inclusion. In addition, when describing embodiments of the disclosure, "can" is used to mean "one or more embodiments of the disclosure". Also, the term "exemplary" is intended to mean exemplary or illustrative.

Unless defined otherwise, all technical and scientific terms used herein have the same meaning as commonly understood by one of ordinary skill in the art to which this application belongs. The terminology used herein in the description of the disclosure is for the purpose of describing particular embodiments only and is not intended to be limiting of the disclosure.

FIG. 1 is a schematic structural diagram of a side surface of a display device 100 according to an embodiment of the disclosure. As shown in FIG. 1, the display device 100 includes a display panel 10 and other components (not shown), where the other components include a power supply module, a signal processor module, a signal sensing module, and the like.

The display panel 10 includes a display area 10*a* for image display and a non-display area 10*b*. The display area 10*a* is configured to display an image(s). The non-display area 10*b* is arranged around the display area 10*a* to dispose other auxiliary components or modules. Specifically, the display panel 10 includes an array substrate 10*c* and an opposite substrate 10*d*, and a display medium layer 10*e* sandwiched between the array substrate 10*c* and the opposite substrate 10*d*. In this embodiment, the display medium in the display medium layer 10*e* is light-emitting semiconductor materials such as a Micro LED, a Mini LED or an LED.

Figure 2:
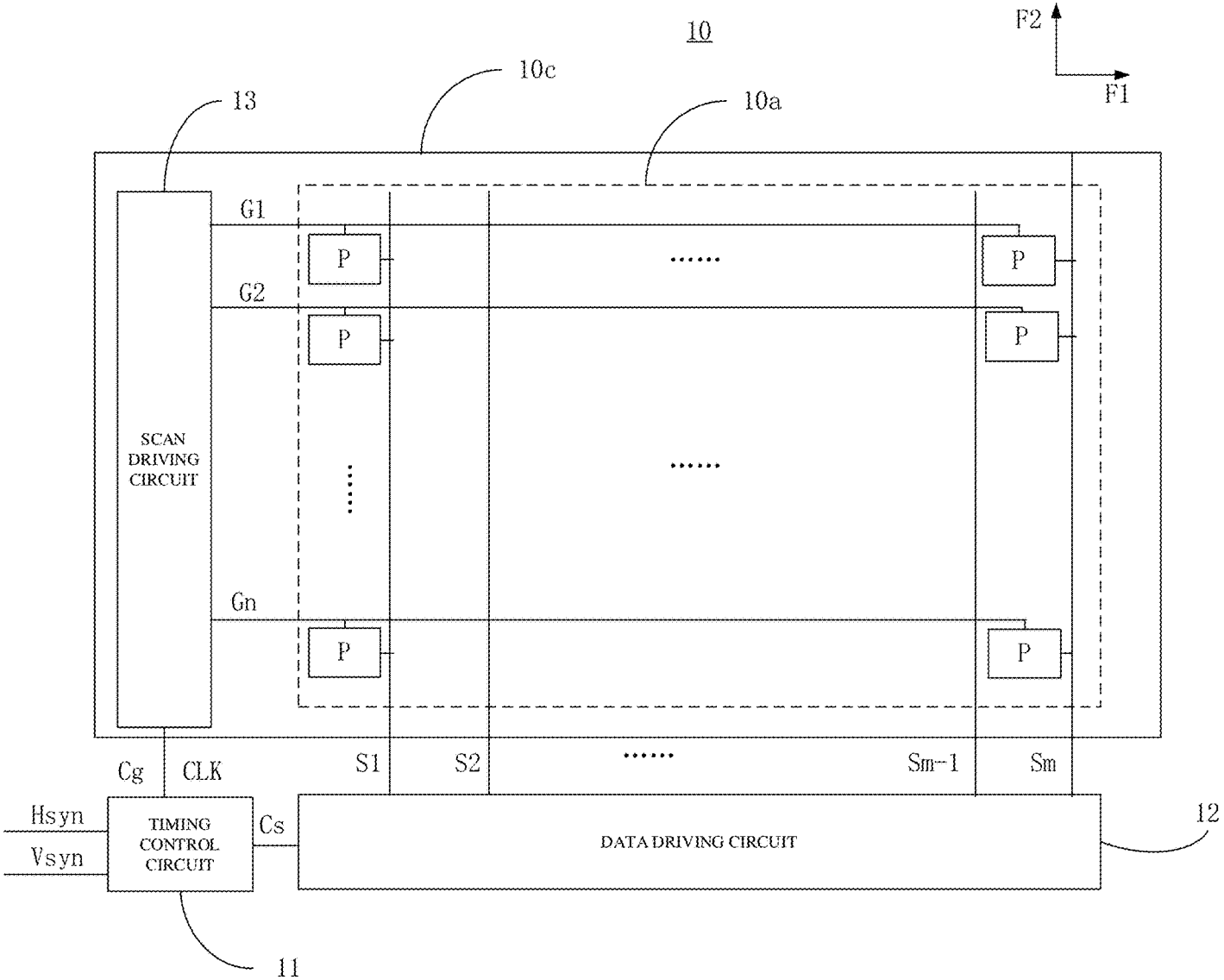
FIG. 2 is a schematic plan layout view of an array substrate in the display panel shown in FIG. 1.

Please refer to FIG. 2, FIG. 2 is a schematic plan layout view of the array substrate 10*c* in the display panel 10 shown in FIG. 1. As shown in FIG. 2, the corresponding image display area 10*a* in the array substrate 10*c* includes multiple m*n pixel units (Pixel) P arranged in a matrix, m data lines (Data Line) S1~Sm, and n scan lines (Gate Line) G1~Gn, m and n are natural numbers greater than 1.

The m data lines S1~Sm are arranged in parallel along a second direction F2 at a first predetermined distance and are mutually insulated from one another, the n scan lines G1 Gn are also arranged in parallel along a first direction F1 at a second predetermined distance and are mutually insulated from one another, the n scan lines G1~Gn and the m data lines S1~Sm are mutually insulated, and the first direction F1 and the second direction F2 are perpendicular to each other.

Corresponding to the non-display area 10*b* of the display panel 10, the display device 100 further includes a timing control circuit 11, a data driving circuit 12, and a scan driving circuit 13, which are configured for driving pixel units to display images and are disposed on the array substrate 10*c*.

The data driving circuit 12 is electrically connected to the m data lines S1~Sm to transmit data signals (Data) used for display to the multiple pixel units P via the m data lines S1~Sm in the form of data voltage.

The scan driving circuit 13 is electrically connected to the n scan lines G1~Gn, and is configured to output a scan signal(s) via the n scan lines G1~Gn to control when the pixel units P receive the data signal(s). The scan driving circuit 13 is configured to output the scan signals from the scan lines G1, G2, . . . , Gn sequentially at a scan cycle in a positional arrangement order of then scan lines G1, . . . , Gn.

The timing control circuit 11 is electrically connected to the data driving circuit 12 and the scan driving circuit 13 respectively, and is configured to control the operation timing of the data driving circuit 12 and the scan driving circuit 13, i. e., to output corresponding timing control signals to the data driving circuit 12 and the scan driving circuit 13, so as to control when to output corresponding scan signals and data signals.

In this embodiment, circuit elements in the scan driving circuit 13 and the pixel units P in the display panel 10 are manufactured to the display panel 10 in the same process, that is, the Gate Driver on Array (GOA) technology.

It can be understood that the display device 100 further includes other auxiliary circuits for jointly displaying an image, such as a Graphics Processing Unit (GPU) and a power supply circuit, which are not repeated in this embodiment.

Specifically, the timing control circuit 11 is configured to receive, from an external signal source, an image signal representing image information, a clock signal CLK for synchronization, a horizontal synchronizing signal Hsync, and a vertical synchronizing signal Vsync, and output scan output control signal Cg and clock signal CLK for controlling the scan driving circuit 13, data output control signal Cs for controlling the data driving circuit 12, and a data signal representing image information. In this embodiment, the timing control circuit 11 is configured to perform data adjustment on the original data signal to obtain the data signal, and transmit the data signal to the data driving circuit 12.

The scan driving circuit 13 is configured to receive the scan output control signal Cg and the clock signal CLK output by the timing control circuit 11, and output the scan signal to the n scan lines G1~Gn. The data driving circuit 12 is configured to receive the data output control signal Cs output by the timing control circuit 11, and outputs the data signal to the m data lines S1~Sm for driving elements in the pixel units P in the display area 10*a* to display an image. The data signal provided to the display panel 10 is an analog grayscale voltage. The scan driving circuit 13 is configured to output the scan signal to control the pixel units P to receive the data signal output by the data driving circuit 12, so as to control the pixel units P to display a corresponding image.

In an exemplary embodiment, the display panel in the embodiment of the disclosure may be an LED display panel, a Mini-LED display panel, a Micro-LED display panel or the like, which is not limited in the disclosure.

Figure 3:
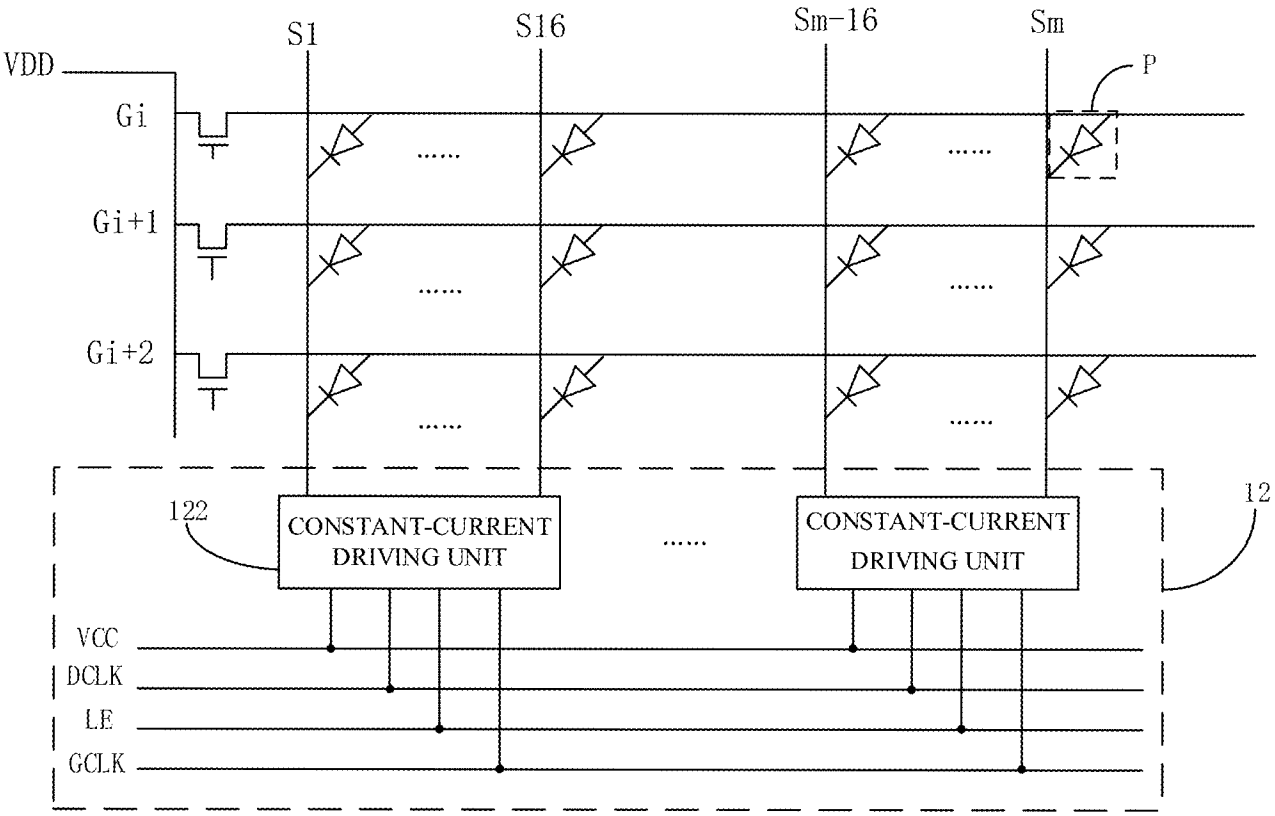
FIG. 3 is a schematic diagram of connection between a data driving circuit and a pixel unit in FIG. 2.

Please refer to FIG. 3, FIG. 3 is a schematic diagram showing the connection between the data driving circuit 12 and the pixel units P in FIG. 2. As shown in FIG. 3, the data driving circuit 12 includes multiple constant-current driving units 122, the constant-current driving units 122 are connected to n scan lines G1~Gn and are configured to transmit data signals used for display to the multiple pixel units P via the m data lines S1~Sm in the form of data voltage. The constant-current driving unit 122 is configured to control to output a data signal of a preset potential to the pixel units P according to a data clock signal DCLK, a grey scale clock signal GCLK, and a latch signal LE, and a power supply voltage VCC is used for providing a power supply for the constant-current driving unit 122.

The pixel unit P includes a light-emitting diode, an anode of the light-emitting diode is connected to a scan line G, and a cathode of the light-emitting diode is connected to a data line S. Each scan line is provided with a MOS transistor. When a gate electrode ("gate" for short) of the MOS transistor receives the scan signal, the MOS transistor is conducted, so that the light-emitting diode connected to the scan line G receives a corresponding drive voltage VDD, thereby increasing the potential at the anode of the light-emitting diode. The data driving circuit 12 can control the luminance of the light-emitting diode by means of Pulse Width Modulation (PWM). The wider the pulse width of the light-emitting diode is, the higher the luminance is. The data driving circuit 12 is configured to output a data signal of a preset potential to the cathode of the light-emitting diode, so that there is a potential difference between two ends of the light-emitting diode to drive the light-emitting diode to emit light.

In embodiments of the disclosure, one constant-current driving unit 122 is connected to 16 data lines S respectively, i. e., for controlling 16 columns of pixel units P to emit light. There can also be other numbers of constant-current driving units 122 according to specific requirements, which is not limited in the present disclosure.

Figure 4:
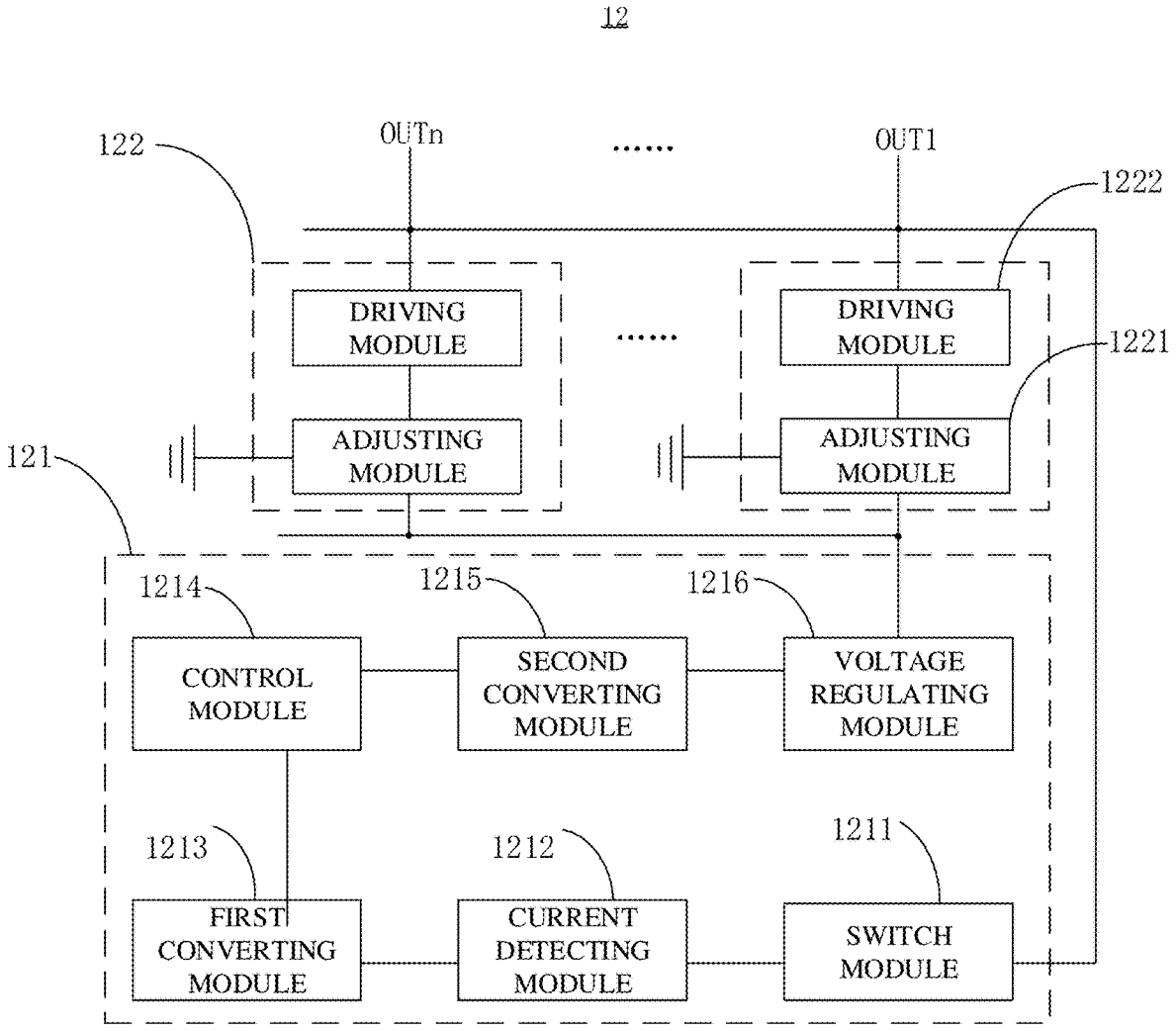
FIG. 4 is a circuit block diagram of the data driving circuit shown in FIG. 3 provided in a second embodiment of the present disclosure.

Please refer to FIG. 4, FIG. 4 is a circuit block diagram of the data driving circuit shown in FIG. 3 provided in a second embodiment of the present disclosure. As shown in FIG. 4, the data driving circuit 12 includes a voltage regulating unit 121 and multiple constant-current driving units 122. The constant-current driving units 122 are configured to output a driving current corresponding to the data signal to at least one pixel unit P. The voltage regulating unit 121 is electrically connected to the multiple constant-current driving units 122 and is configured to detect the driving current output by each of the constant-current driving units 122 to obtain a detection signal, and control the driving current output by each constant-current driving unit 122 to be within a preset range according to the detection signal, thus, the luminance of the pixel unit P can be controlled to be the preset luminance.

The voltage regulating unit 121 includes a switch module 1211, a current detecting module 1212, a first converting module 1213, and a control module 1214.

The switch module 1211 is configured to choose different constant-current driving units 122 to be connected with the current detecting module 1212. The current detecting module 1212 is configured to detect via the switch module 1211 the driving current output by the constant-current driving unit 122 and output a first current detection signal. In other words, the current detecting module 1212 is electrically connected to multiple current output ends OUT of multiple constant-current driving units 122 via the switch module 1211, to detect the magnitude of the current output from at least one constant-current driving unit 122. The multiple current output ends OUT are first output end OUT1 to the n-th output end OUTn.

The first converting module 1213 is electrically connected to the current detecting module 1212, and is configured to receive the first current detection signal from the current detecting module 1212, convert the first current detection signal into a digital detection signal, and transmit the detection signal to the control module 1214.

The control module 1214 is configured to output a control signal to the constant-current driving unit 122 according to the detection signal, where the control signal is used for controlling and adjusting the current output by the constant-current driving unit 122. The control module 1214 is configured to compare the detection signals received from one or more constant-current driving units 122 and display in real time on a visual interface, and identify a constant-current driving unit 122 of which a current detection signal exceeds a threshold range. For the constant-current driving unit 122 of which the current detection signal exceeds the threshold range, the control module 1214 is configured to output a corresponding control signal to the constant-current driving unit 122 to adjust the current output by the constant-current driving unit 122.

The voltage regulating unit 121 further includes a second converting module 1215 and a voltage regulating module 1216. The second converting module 1215 is electrically connected to the control module 1214 and is configured to receive the control signal from the control module 1214 and convert the control signal in a digital form into a control signal in an analog form.

The voltage regulating module 1216 is electrically connected to the second converting module 1215 and is configured to receive the control signal in the analog form from the second converting module 1215 and regulate the driving current output by the constant-current driving unit according to the control signal.

The constant-current driving unit 122 includes an adjusting module 1221 and a driving module 1222. The adjusting module 1221 is electrically connected to a voltage regulating module 1216 in the voltage adjustment unit 121 and the driving module 1222, and is configured to control an internal resistance of the adjusting module 1221 according to the control signal. The driving module 1222 is configured to adjust a driving current output to be within a preset range according to a resistance of the adjusting module 1221. The driving module 1222 is configured to output a corresponding data signal to the pixel units P.

The first converting module may be an Analog to Digital Converter (ADC), and the second converting module may be a Digital to Analog converter (DAC).

Figure 5:
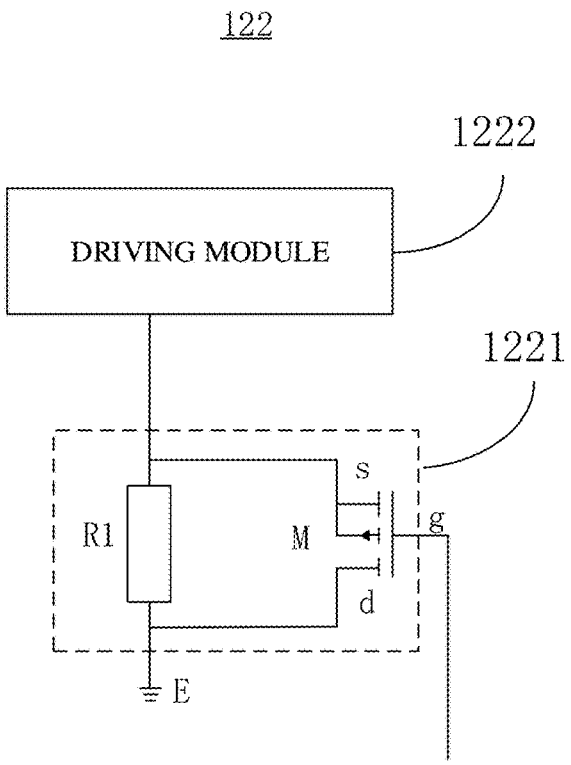
FIG. 5 is an equivalent circuit diagram of a constant-current driving unit in FIG. 4.

Please refer to FIG. 5, FIG. 5 is an equivalent circuit diagram of the constant-current driving unit in FIG. 4. As shown in FIG. 5, in the constant-current driving unit 122, the adjusting module 1221 includes a first resistor R1 and a switch transistor M. The first resistor R1 and the switch transistor M are connected in parallel between the ground end E and the driving module 1222, and are configured to adjust the internal resistance of the adjusting module 1221 under control of the voltage regulating module 1216, so as to control magnitude of a current output by the driving module 1222.

In an exemplary embodiment, the switch transistor M may be an Enhanced P-channel field-effect transistor, that is, P-MOS transistor, and certainly may also be other types of switch transistors, which is not limited in the disclosure.

A gate electrode ("gate" for short) of the switch transistor M is electrically connected to the voltage regulating module 1216, a source electrode ("source" for short) of the switch transistor M is electrically connected to the driving module 1222, and a drain electrode ("drain" for short) of the switch transistor M is electrically connected to the ground end E. The voltage regulating module 1216 is configured to adjust a gate voltage of the switch transistor M and control the switch transistor M to operate in a variable resistance region according to the control signal, and adjust the internal resistance of the switch transistor M according to the gate voltage, so as to adjust the internal resistance of the adjusting module.

Figure 6:
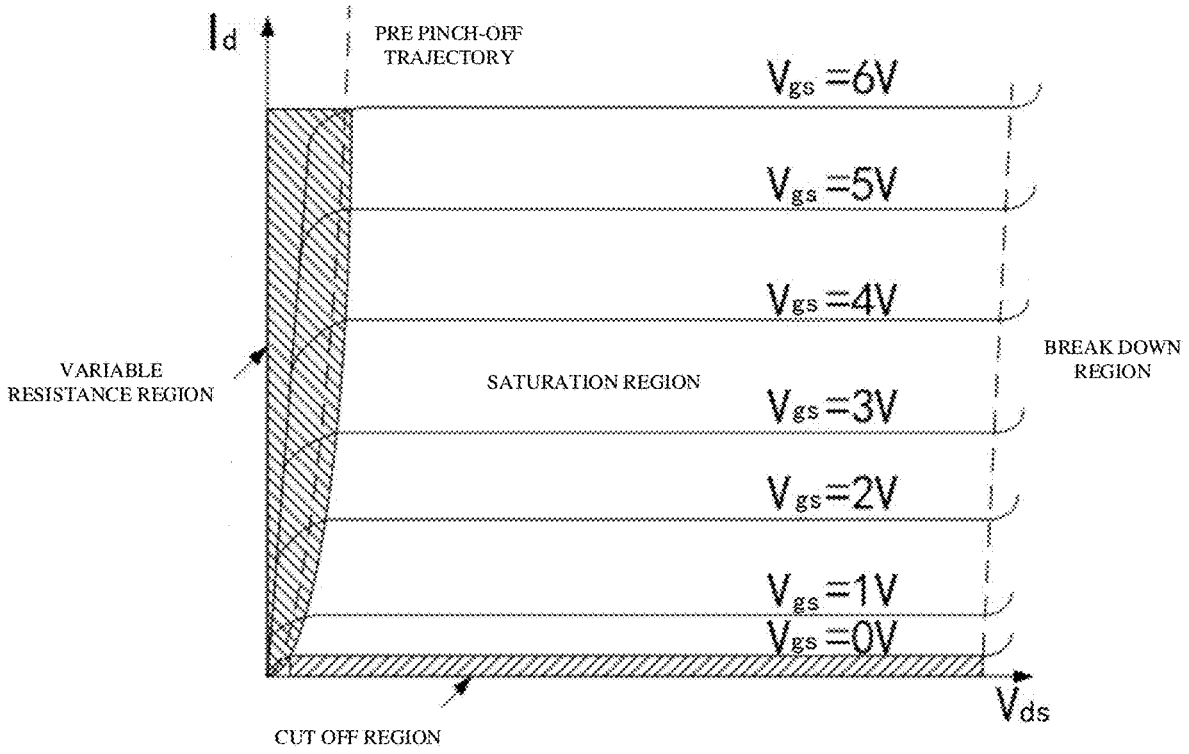
FIG. 6 is a schematic diagram of an output characteristic curve of the switch transistor in FIG. 5.

Please also refer to FIG. 6, FIG. 6 is a schematic diagram of an output characteristic curve of the switch transistor in FIG. 5. As shown in FIG. 6, when a voltage is applied between the gate g and the source s of the switch transistor M, drain currents Id of the switch transistor M are different with respect to different voltages, so that the drain d current can be controlled by using low-frequency transconductance gm of the switch transistor M.

The drain d current is mainly controlled in the variable resistance region of the switch transistor M. In the variable resistance region, when the source-drain voltage Vds between the source s and the drain d is less than a difference between the gate-source voltage Vgs and the threshold voltage Vth of the switch transistor ($Vds<Vgs-Vth$), the switch transistor M operates in the variable resistance region, where the gate-source voltage Vgs is a voltage between the gate g and the source s. In the variable resistor region, the channel resistance of the switch transistor M is only controlled by the voltage between the gate g and the source s, i. e., the gate-source voltage Vgs, and in this case, it is equivalent to having between the source s and the drain d of the switch transistor a variable resistor controlled by the gate-source voltage Vgs.

The low-frequency transconductance of the switch transistor M is $gm=\Delta Id/\Delta Vgs$, where A Id is the current variation of the drain d.

The equivalent resistance between the source s and the drain d of the switch transistor M is $Rds=1/gm$.

When the switch transistor M is connected to the first resistor R1 in parallel, the constant-current driving unit 122 outputs a current $Iout=A*Ga/(Rds*R1)/(Rds+R1)$. Where A is a driving module constant, and Ga is a current gain set by an internal register of the driving module. The current gain is set by software and limited by a constant-current driving module architecture.

Therefore, the voltage regulating module 1216 regulates the magnitude of the voltage at the gate g of the switch transistor M according to the control signal, so as to regulate the resistance of the switch transistor M. Then, by means of resistance conversion of parallel connected first resistor R1 and switch transistor M, the current output by the driving module 1222, that is, the output current Iout of the constant-current driving unit 122, is finally controlled.

Figure 7:
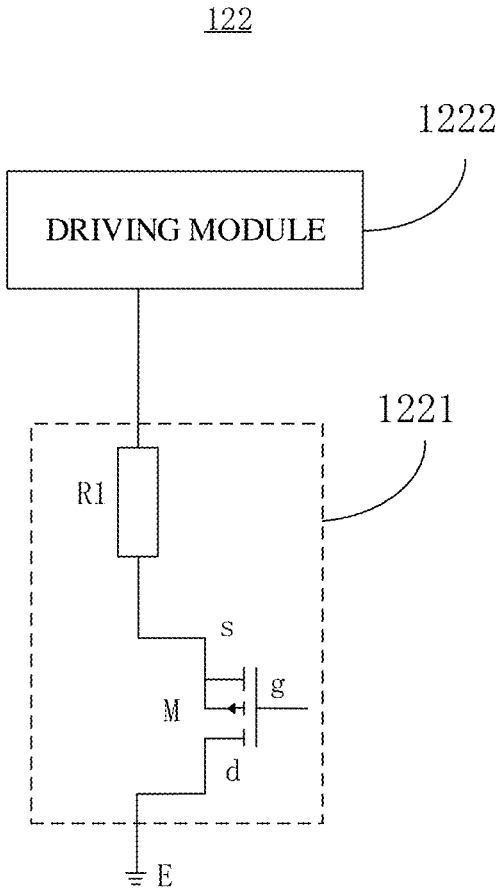
FIG. 7 is an equivalent circuit diagram of the constant-current driving unit as shown in FIG. 4 provided in a third embodiment of the present disclosure.

Please refer to FIG. 7, FIG. 7 is an equivalent circuit diagram of the constant-current driving unit shown in FIG. 4 provided in a third embodiment of the present disclosure. As shown in FIG. 7, the switch transistor M and the first resistor R1 are connected in series between the ground end E and the driving module 1222. The gate g of the switch transistor M is connected to the voltage regulating module 1216, the source s of the switch transistor M is connected to the first resistor R1, and the drain d of the switch transistor M is connected to the ground end E. The voltage regulating module 1216 is configured to adjust the gate voltage of the switch transistor M and control the switch transistor M to operate in the variable resistor region according to the control signal, and configured to adjust the internal resistance of the switch transistor M according to the gate voltage, so as to adjust the internal resistance of the adjusting module 1221 to control the magnitude of the current output by the driving module 1222. The output current Iout of the constant-current driving unit 122 is Iout=A*Ga/R1+Rds.

Figure 8:
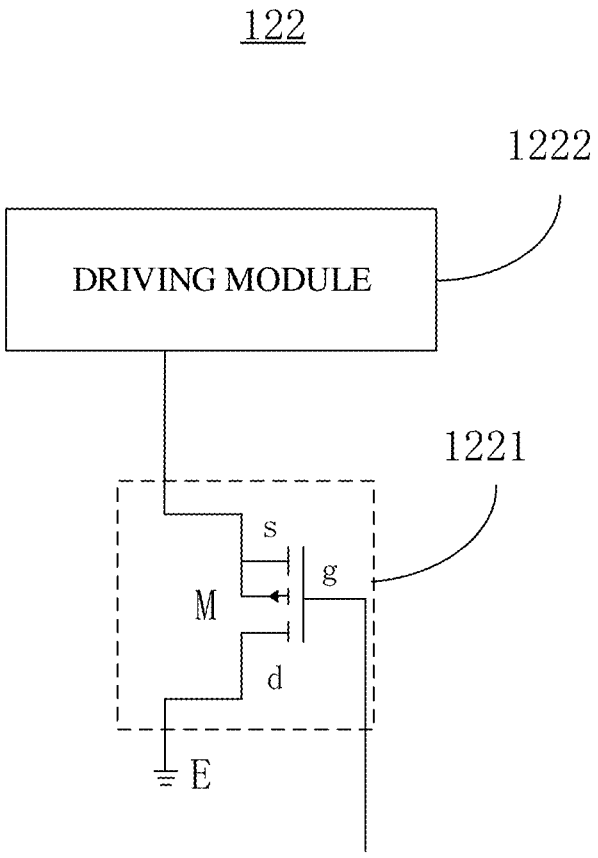
FIG. 8 is an equivalent circuit diagram of the constant-current driving unit as shown in FIG. 4 provided in a fourth embodiment of the disclosure.

Please refer to FIG. 8, FIG. 8 is an equivalent circuit diagram of the constant-current driving unit shown in FIG. 4 provided in a fourth embodiment of the present disclosure. As shown in FIG. 8, the constant-current driving unit 122 includes the adjusting module 1221 and a driving module 1222. The adjusting module 1221 includes at least one switch transistor M. The switch transistor is electrically connected between the driving module 1222 and the ground end E. The gate g of the switch transistor M is connected to the voltage regulating module 1216. The source s of the switch transistor M is connected to the driving module 1222. The drain d of the switch transistor is connected to the ground end E.

The voltage regulating module 1216 is configured to regulate the gate voltage of the switch transistor M and control the switch transistor M to operate in the variable resistor region according to the control signal, and regulate the internal resistance of the switch transistor M according to the gate voltage, thus regulating the internal resistance of the regulating module 1221. In other words, the voltage regulating module 1216 is configured to regulate the magnitude of the voltage at the gate g of the switch transistor M according to the control signal, so as to regulate the resistance of the switch transistor M. By changing the resistance of the switch transistor M, the magnitude of the current output by the driving module 1222 to the pixel unit P is controlled. As a result, the magnitude of the current output by each constant-current driving unit 122 to the pixel units P is within the threshold range, so that the display panel 10 can display more evenly as a whole. The output current Iout of the constant-current driving unit 122 is Iout=A*Ga/Rds.

Figure 9:
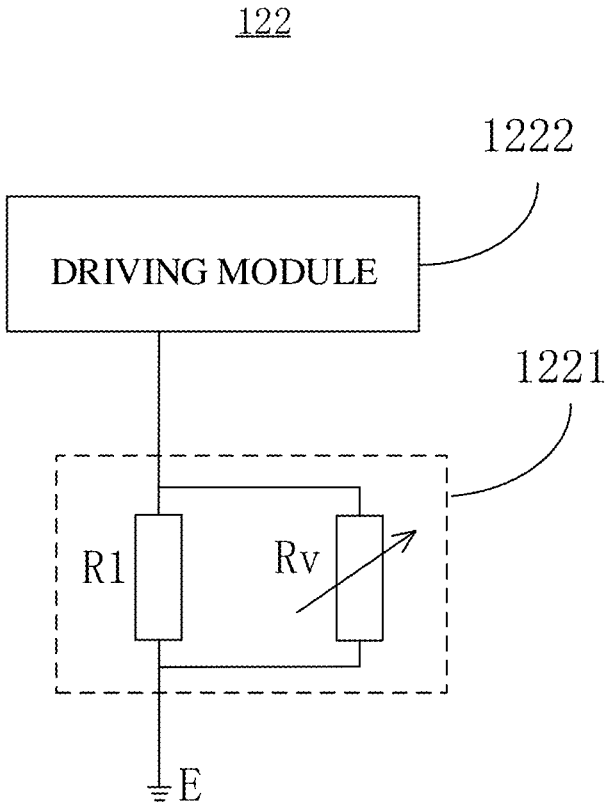
FIG. 9 is an equivalent circuit diagram of the constant-current driving unit as shown in FIG. 4 provided in a fifth embodiment of the present disclosure.

Please refer to FIG. 9, FIG. 9 is an equivalent circuit diagram of the constant-current driving unit shown in FIG. 4 provided in a fifth embodiment of the present disclosure. As shown in FIG. 9, the constant-current driving unit 122 includes the adjusting module 1221 and the driving module 1222. The adjusting module 1221 includes the first resistor R1 and an adjustable resistor Rv. The first resistor R1 and the adjustable resistor Rv are connected in parallel between the ground end E and the driving module 1222, and the resistance of the adjustable resistor Rv is controlled by the voltage regulating module 1216. The voltage regulating module 1216 is configured to control and adjust the resistance of the adjustable resistor Rv, so as to control the overall resistance of the adjusting module 1221, and thus control the magnitude of the current output by the driving module 1222, i. e., the output current Iout of the constant-current driving unit 122, where Iout=A*Ga/(Rv*R1)/(Rv+R1).

Figure 10:
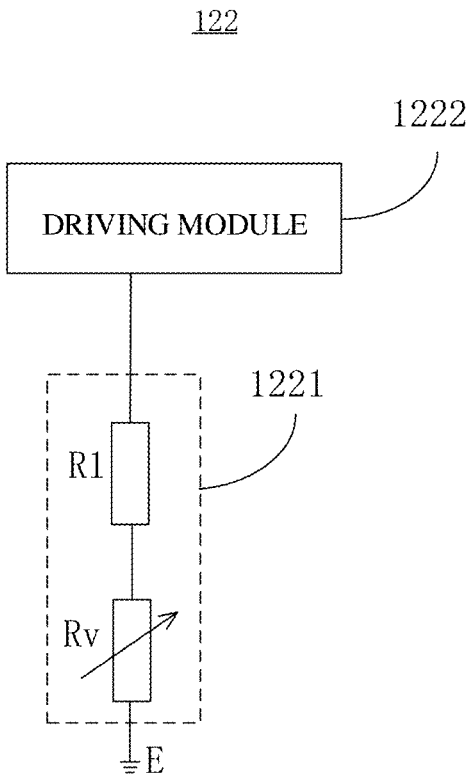
FIG. 10 is an equivalent circuit diagram of the constant-current driving unit shown in FIG. 4 provided in a sixth embodiment of the present disclosure.

Please refer to FIG. 10, FIG. 10 is an equivalent circuit diagram of the constant-current driving unit shown in FIG. 4 provided in a sixth embodiment of the present disclosure. As shown in FIG. 10, the first resistor R1 and the adjustable resistor Rv are connected in series between the ground end E and the driving module 1222. The voltage regulating module 1216 is configured to control the resistance of the adjustable resistor Rv to control the overall resistance of the adjusting module 1221, and thus control the magnitude of the current output by the driving module 1222, i. e., the output current Iout of the constant-current driving unit 122, where Iout=A*Ga/(Rv*R1).

Figure 11:
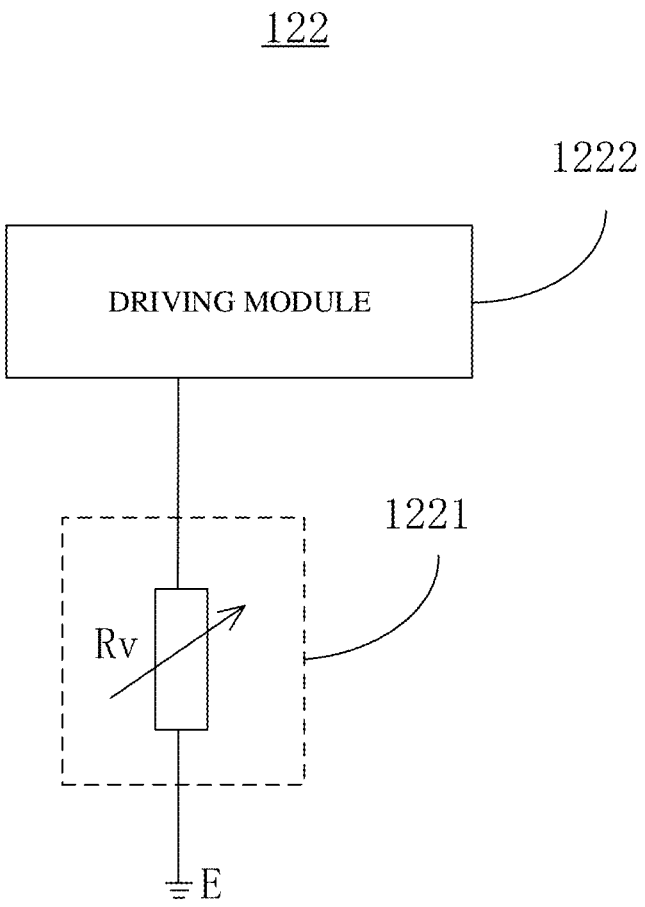
FIG. 11 is an equivalent circuit diagram of the constant-current driving unit shown in FIG. 4 provided in a seventh embodiment of the present disclosure.

Please refer to FIG. 11, FIG. 11 is an equivalent circuit diagram of the constant-current driving unit shown in FIG. 4 provided in a seventh embodiment of the disclosure. As shown in FIG. 11, the constant-current driving unit 122 includes the adjusting module 1221 and the driving module 1222. The adjusting module 1221 includes the adjustable resistor Rv, the resistance of the adjustable resistor Rv is controlled by the voltage regulating module 1216, and the voltage regulating module 1216 is configured to control and adjust the resistance of the adjustable resistor Rv to control the overall resistance of the adjusting module 1221, so as to control the magnitude of the current output by the driving module 1222, i. e. an output current Iout of the constant-current driving unit 122, where Iout=A*Ga/Rv.

Compared with the prior art, in the data driving circuit disclosed herein, each constant-current driving unit is provided with a corresponding adjusting module.

By providing a corresponding adjusting module for each constant-current driving unit, and performing feedback adjustment on the constant-current driving unit by means of the current output by the constant-current driving unit, so as to control the current output by the constant-current driving unit to be maintained within a preset range, thereby effectively controlling the driving currents of multiple pixel units to be within a preset difference, so that a difference between currents output by any two constant-current driving units in the data driving circuit is within a preset range. Thus, the uniformity of the overall image display is improved.

It should be understood that the application of the disclosure is not limited to the above examples, and those skilled in the art can make improvements or modifications according to the above descriptions, and all these improvements and modifications shall belong to the scope of protection of the appended claims of the disclosure.

What is claimed is:

1. A data driving circuit, wherein the data driving circuit is configured to output a data signal for image display to a plurality of pixel units to drive the pixel units to display images, wherein the data driving circuit comprises a voltage regulating unit and a plurality of constant-current driving units, the constant-current driving unit is configured to output a driving current corresponding to the data signal to pixel units in a plurality of columns or rows, the voltage regulating unit is electrically connected to the plurality of constant-current driving units, and is configured to detect the driving current output from each constant-current driving unit to each column of pixel units or each rows of pixel units, to obtain a detection signal and control, according to the detection signal, the driving current output by each constant-current driving unit to be within a preset range;

wherein the voltage regulating unit comprises a switch module, a current detecting module, a first converting module, and a control module;

the switch module is connected to a plurality of constant-current driving units, and configured to select different constant-current driving units to be connected to the current detecting module, the current detecting module is configured to detect via the switch module the driving current output by the constant-current driving unit and output a first current detection signal;

the first converting module is electrically connected to the current detecting module and is configured to receive the first current detection signal from the current detecting module, convert the first current detection signal into a detection signal in a digital form, and transmit the detection signal to the control module; and the control module is configured to output a control signal to the constant-current driving unit according to the detection signal;

the constant-current driving unit comprises an adjusting module and a driving module connected in series, the driving module is electrically connected between the pixel unit and the adjusting module, the adjusting module is configured to adjust an internal resistance of the adjusting module according to the control signal, the driving module is configured to adjust the driving current output to the pixel unit to be within the preset range according to the resistance of the adjusting module.

2. The data driving circuit of claim 1, wherein the voltage regulating unit further comprises a second converting module and a voltage regulating module, the second converting module is electrically connected to the control module and is configured to receive the control signal from the control module, and convert the control signal in the digital form into the control signal in an analog form;

the voltage regulating module is electrically connected to the second converting module and is configured to receive the control signal in the analog form from the second converting module and regulate, according to the control signal, the driving current output by the constant-current driving unit.

3. The data driving circuit of claim 2, wherein the adjusting module comprises at least one switch transistor electrically connected between the driving module and a ground end;

a gate of the switch transistor is electrically connected to the voltage regulating module, a source of the switch transistor is electrically connected to the driving module, and a drain of the switch transistor is connected to the ground end; and the voltage regulating module is configured to regulate a gate voltage of the switch transistor and control the switch transistor to operate in a variable resistance region according to the control signal, and adjust the internal resistance of the switch transistor according to the gate voltage, so as to adjust the internal resistance of the adjusting module.

4. The data driving circuit of claim 2, wherein the adjusting module comprises a first resistor and a switch transistor, the first resistor and the switch transistor are connected in parallel between the driving module and a ground end;

a gate of the switch transistor is electrically connected to the voltage regulating module, and a source of the switch transistor is electrically connected to the driving module, and a drain of the switch transistor is electrically connected to the ground end; and the voltage regulating module is configured to adjust a gate voltage of the switch transistor and control the switch transistor to operate in a variable resistance region according to the control signal, and adjust the internal resistance of the switch transistor according to the gate voltage, so as to adjust the internal resistance of the adjusting module.

5. The data driving circuit of claim 2, wherein the adjusting module comprises a first resistor and a switch transistor, the first resistor and the switch transistor are connected in series between the driving module and a ground end, one end of the first resistor is electrically connected to the driving module, and the other end of the first resistor is electrically connected to the source of the switch transistor, the gate of the switch transistor is electrically connected to the voltage regulating module, and the drain of the switch transistor is electrically connected to the ground end;

the voltage regulating module is configured to adjust the gate voltage of the switch transistor and control the switch transistor to operate in a variable resistance region according to the control signal, and adjust the internal resistance of the switch transistor according to the gate voltage, so as to adjust the internal resistance of the adjusting module.

6. The data driving circuit of claim 2, wherein the adjusting module comprises an adjustable resistor, the adjustable resistor is electrically connected between the driving module and a ground end, and the voltage regulating module is configured to adjust a resistance of the adjustable resistor according to the control signal, so as to adjust the internal resistance of the adjusting module.

7. The data driving circuit of claim 2, wherein the adjusting module comprises a first resistor and an adjustable resistor, the first resistor and the adjustable resistor are connected in parallel between the driving module and a ground end, or the first resistor and the adjustable resistor are connected in series between the driving module and the ground end;

the voltage regulating module is configured to adjust a resistance of the adjustable resistor according to the control signal, and then adjust an internal resistance of the adjusting module according to the resistance of the adjustable resistor.

8. A display panel, comprising a display area and a non-display area, wherein the display area comprises a plurality of pixel units arranged in an array, each pixel unit comprises at least one light-emitting element, and the non-display area comprises a timing control circuit, a scan driving circuit, and the data driving circuit of claim 1, wherein the timing control circuit is configured to receive an original data signal from an external signal source, output a data output control signal to the data driving circuit, and output a scan output control signal to the scan driving circuit, the data driving circuit is configured to output a plurality of data signals to a plurality of columns of pixel units according to the data output control signal, and the scan driving circuit is configured to output a scan signal to a plurality of rows of pixel units according to the scan output control signal, wherein the data signal and the scan signal cooperate to provide a driving current for the light-emitting element in the pixel unit, and the light emitting element is configured to emit light and display images according to a potential difference between the data signal and the scan signal.

9. The data driving circuit of claim 8, wherein the voltage regulating unit further comprises a second converting module and a voltage regulating module, the second converting module is electrically connected to the control module and is configured to receive the control signal from the control module, and convert the control signal in the digital form into the control signal in an analog form;

the voltage regulating module is electrically connected to the second converting module and is configured to receive the control signal in the analog form from the second converting module and regulate, according to the control signal, the driving current output by the constant-current driving unit.

10. The data driving circuit of claim 9, wherein the adjusting module comprises at least one switch transistor electrically connected between the driving module and a ground end;

a gate of the switch transistor is electrically connected to the voltage regulating module, a source of the switch transistor is electrically connected to the driving module, and a drain of the switch transistor is connected to the ground end; and the voltage regulating module is configured to regulate a gate voltage of the switch transistor and control the switch transistor to operate in a variable resistance region according to the control signal, and adjust the internal resistance of the switch transistor according to the gate voltage, so as to adjust the internal resistance of the adjusting module.

11. The data driving circuit of claim 9, wherein the adjusting module comprises a first resistor and a switch transistor, the first resistor and the switch transistor are connected in parallel between the driving module and a ground end;

a gate of the switch transistor is electrically connected to the voltage regulating module, and a source of the switch transistor is electrically connected to the driving module, and a drain of the switch transistor is electrically connected to the ground end; and the voltage regulating module is configured to adjust a gate voltage of the switch transistor and control the switch transistor to operate in a variable resistance region according to the control signal, and adjust the internal resistance of the switch transistor according to the gate voltage, so as to adjust the internal resistance of the adjusting module.

12. The data driving circuit of claim 9, wherein the adjusting module comprises a first resistor and a switch transistor, the first resistor and the switch transistor are connected in series between the driving module and a ground end, one end of the first resistor is electrically connected to the driving module, and the other end of the first resistor is electrically connected to the source of the switch transistor, the gate of the switch transistor is electrically connected to the voltage regulating module, and the drain of the switch transistor is electrically connected to the ground end;

the voltage regulating module is configured to adjust the gate voltage of the switch transistor and control the switch transistor to operate in a variable resistance region according to the control signal, and adjust the internal resistance of the switch transistor according to the gate voltage, so as to adjust the internal resistance of the adjusting module.

13. The data driving circuit of claim 9, wherein the adjusting module comprises an adjustable resistor, the adjustable resistor is electrically connected between the driving module and a ground end, and the voltage regulating module is configured to adjust a resistance of the adjustable resistor according to the control signal, so as to adjust the internal resistance of the adjusting module.

14. The data driving circuit of claim 9, wherein the adjusting module comprises a first resistor and an adjustable resistor, the first resistor and the adjustable resistor are connected in parallel between the driving module and a ground end, or the first resistor and the adjustable resistor are connected in series between the driving module and the ground end;

the voltage regulating module is configured to adjust a resistance of the adjustable resistor according to the control signal, and then adjust an internal resistance of the adjusting module according to the resistance of the adjustable resistor.

* * * * *